US007260875B2

(12) United States Patent
Stündl et al.

(10) Patent No.: US 7,260,875 B2
(45) Date of Patent: Aug. 28, 2007

(54) CERAMIC NOZZLE AND APPARATUS FOR STUFFER BOX CRIMPING A SYNTHETIC MULTIFILAMENT YARN

(75) Inventors: Mathias Stündl, Wedel (DE); Patrick Buchmüller, Ebnat-Kappel (CH)

(73) Assignee: Saurer GmbH & Co. KG, Monchengladbach (DE)

( * ) Notice: Subject to any disclaimer, the term of this patent is extended or adjusted under 35 U.S.C. 154(b) by 172 days.

(21) Appl. No.: 11/224,625

(22) Filed: Sep. 12, 2005

(65) Prior Publication Data

US 2006/0053606 A1 Mar. 16, 2006

(30) Foreign Application Priority Data

Sep. 10, 2004 (DE) ..... 10 2004 043 773

(51) Int. Cl.
*D02G 1/20* (2006.01)

(52) U.S. Cl. ..... 28/258; 28/263; 28/271

(58) Field of Classification Search ..... 28/221, 28/258, 271, 263, 220, 247, 254, 262, 264–268, 28/272–276
See application file for complete search history.

(56) References Cited

U.S. PATENT DOCUMENTS 3,296,677 A * 1/1967 Chase ..... 28/255
3,638,291 A * 2/1972 Yngve ..... 28/273
3,710,460 A * 1/1973 Segraves ..... 28/271
4,063,338 A * 12/1977 Wyatt ..... 28/221
4,949,441 A * 8/1990 Ethridge ..... 28/271
5,119,623 A * 6/1992 Fetzer et al. ..... 57/333
5,157,819 A * 10/1992 Hodan ..... 28/271
5,433,365 A * 7/1995 Davies ..... 226/97.4
6,308,388 B1 * 10/2001 Haider ..... 28/271
6,311,376 B1 * 11/2001 Hinchliffe et al. ..... 28/272
6,609,278 B1 * 8/2003 Ritter et al. ..... 28/271
2004/0237211 A1 12/2004 Stundl

FOREIGN PATENT DOCUMENTS

EP 1 060 302 B9 12/2000
EP 1 116 806 A2 7/2001
WO WO 03/004743 A1 1/2003

* cited by examiner

*Primary Examiner*—Amy B. Vanatta
(74) *Attorney, Agent, or Firm*—Alston & Bird LLP

(57) ABSTRACT

A stuffer box yarn crimping apparatus for crimping a synthetic multifilament yarn 14. The apparatus includes a feed nozzle 2 which comprises a divided nozzle body, consisting of two molded ceramic components 1. Preferably, the molded ceramic components 1 are made in the form of two flat plates, and combined with precision via fitting means 5, 26, 8, 29. The molded ceramic components 1 abut each other via their two plane surfaces 4, and form together a nozzle tip 50, which extends into a plug channel 40 and, when put together, borders the entire channel with ceramic.

22 Claims, 5 Drawing Sheets

CERAMIC NOZZLE AND APPARATUS FOR STUFFER BOX CRIMPING A SYNTHETIC MULTIFILAMENT YARN

BACKGROUND OF THE INVENTION

The present invention relates to an apparatus for stuffer box crimping a synthetic multifilament yarn which includes a ceramic nozzle.

For stuffer box crimping a multifilament yarn, known apparatus comprise a feed nozzle and a stuffer box chamber downstream of the feed nozzle. In these apparatus, the feed nozzle advances the yarn into the stuffer box chamber, wherein it is compacted to a yarn plug, and crimped. The feed nozzle is biased with a conveying medium, preferably a heated gas, which advances the yarn inside a yarn channel to the stuffer box chamber. Inside the stuffer box chamber, the yarn plug is formed. In so doing, the multifilament yarn comes to lie in loops on the surface of the yarn plug, and is compacted by the conveying medium, which is able to escape from the stuffer box chamber upstream of the yarn plug. To this end, the wall of the stuffer box chamber includes on its circumference a plurality of slotted openings, through which the conveying medium is able to leave.

To obtain a uniform crimp of the yarn, the plug formation in the stuffer box chamber proceeds with very great uniformity. In this process, the frictional forces that form by the relative movement of the yarn plug have a substantial influence on the texturing process. There exists equilibrium of forces respectively between the advancing action or impact pressure action of the conveying medium advancing from the yarn channel of the feed nozzle and the braking actions exerted on the yarn plug by frictional forces. By adjusting a conveying pressure or by adjusting a removal of the conveying medium by additional suction, it is possible to adjust or control the advancing action. In comparison therewith, the braking action generated by the friction between the yarn plug and the chamber wall is largely dependent on the condition of the chamber wall.

EP 1 060 302 discloses a device for treating yarn, which comprises a releasable screw-type connection. A treatment body constructed in two pieces consists of at least one ceramic component. When being assembled, the two components are positioned relative to each other by means of alignment pins. The treatment body is then secured to a machine frame by means of a screw extending through it. The device relates in particular to texturing nozzles, which can thus be made relatively small.

EP 1 116 806 discloses a known device for stuffer box crimping, which comprises a texturing nozzle for treating a filament-type material in a treatment channel formed between at least two overlying base bodies. In the treatment channel, the device furthermore comprises at least one nozzle body for supplying a gaseous treatment medium and at least one venting component. It is there proposed to make the treatment channel at least in sections of a more resistant material than the metallic base body. To this end, different one-piece ceramic inserts are positioned in the region of the nozzle channel. It is known that the temperature expansion coefficient varies greatly between ceramic and metallic material. Since both high temperatures and temperature fluctuations occur during the stuffer box crimping process, the device for stuffer box crimping may be subjected in operation to greatly differing thermal loads, which under circumstances cause the components of the device to shift in position and thus lead to a faulty formation of the yarn plug.

A further device for stuffer box crimping is disclosed, for example, in WO 03/004743 and corresponding U.S. Patent Publ. No. 2004/0237211, wherein a specially preferred embodiment of the device is configured such that the gas-permeable chamber wall includes on the inner side facing the yarn plug a friction surface of a wear-resistant material, in particular ceramic material. Besides the wear-resistant effect, providing a material of this type in this region also results in that the gas-permeable wall is resistant to corrosion and less susceptible to contaminations. With that, it is possible to prevent in particular yarn lubricant residues from depositing.

WO 03/004743 furthermore discloses an embodiment of a feed nozzle. The feed nozzle comprises a base body and a plurality of guide inserts in spaced relationship, which are advantageously made of a ceramic material, or which may be provided with a corresponding coating. This ensures that points of contact and friction which are greatly subject to the stress of the yarn consist of a wear-resistant material, so as to achieve a stable and uniform advance and feed of the yarn. In addition, the coefficients of friction between the yarn and the points of contact and friction are considerably reduced.

While until now the known device has turned out to be reliable, further technical problems have surfaced in connection with the objective of having devices of a simple construction, which have a long service life on the one hand, and permit a uniform production of the yarn plug on the other hand. As already disclosed in WO 03/004743 and the corresponding U.S. publication noted above, there has previously existed a need for making portions of the devices of solid ceramic, which are contacted by the yarn. This applies in particular also to the feed nozzle. A problem in this connection is that the ceramic components of the device must be assembled with additional components of the device. The cause for the technical problems essentially lies in the different thermal expansion behavior of ceramic and metal. Thus, the combination of ceramic components and metallic components presents a problem in particular where great temperature fluctuations occur. In the present case, this applies in particular to the region of the feed nozzle. In this region of the device, temperature fluctuations occur in a range from room temperature to about 300° C. At the same time, a particularly high precision in the feed or advance of the yarn is required just in this region, so that the position of the individual components relative to one another is to be maintained as exactly as possible during operation.

Based on the foregoing, it is an object of the present invention to provide means, which solve the technical problems as have been described with reference to the state of the art, at least in part, or which lessen their disadvantages.

It is also an object of the invention to provide components of a ceramic nozzle for producing yarn plugs, which can be mounted to metallic components in a durable manner and with high precision, even when considerable temperature fluctuations occur in the vicinity.

It is a further object to provide a device for stuffer box crimping a synthetic multifilament yarn with improved protection against wear with respect to yarn guiding components.

SUMMARY OF THE INVENTION

The above and other objects and advantages of the invention are achieved by the provision of a device for stuffer box crimping a synthetic multifilament yarn which comprises a housing which is composed of metallic material. Further, the device comprises at least one ceramic nozzle which comprises at least two molded ceramic components having respective plane surfaces which are disposed in overlying face to face relationship. At least one of the plane surfaces has a recess and so that the recess defines a nozzle channel for passage of the yarn. In accordance with the invention, separate means are provided for each molded component to join it to the housing, which comprises a formfitting mount and a second mount which includes an elongate guideway in a plane parallel to the plane surface and so as to permit limited relative movement between the component and the housing at the second mount.

"Housing" as used in the present application means in particular the component of such a device, which is arranged adjacent to the ceramic nozzle or the molded components. While one may provide for a one-piece construction of the housing, it is preferred to construct the housing of several pieces, so that each receptacle in the housing is in contact with only one of the two molded components. The housing contacts the molded components directly or via fasteners, such as screws, pins, studs, stop surfaces, etc. In particular, the molded components are spatially secured or positioned with respect to this housing. The proposed fastening makes use of two different methods, namely on the one hand a formfitting mount, and on the other hand a guideway which extends along an axis. The formfitting mount ensures that in the vicinity of this mounting point, a relative movement between the housing and the molded components (except a rotation, if need be) can occur only to an insignificant extent. Preferably, it precludes such a relative movement. Contrary thereto, the guide point with the elongate guideway results in that a displacement of the housing relative to the molded component is permitted, i.e., it is allowed to occur. In other words, this also means that one can consider the formfitting mount as reference point, which remains substantially unchanged during the operation of such a device, whereas the elongate guideway permits at least in part different distances toward the formfitting mount.

According to a particularly advantageous embodiment, the molded ceramic components are joined via an alignment pin such that both the yarn feed channel near an inlet of the ceramic nozzle and the subsequent nozzle channel exhibit a highest possible precision in their assembled state. It is preferred to define with the alignment pin also the exact position of the two molded ceramic components in the housing, which comprises the molded ceramic components and is formed at least in part of a metallic material.

The molded component for a ceramic nozzle comprises a circumferential surface and a plane surface, with at least two bores being provided, which extend through the circumferential surface. The plane surface contains at least one recess for forming a nozzle channel. Each molded component of ceramic material is preferably made in one piece. The molded component can be manufactured by at least one of the production processes, such as pressing, sintering, grinding. "Molded component" means at least one half of a ceramic nozzle, with the plane surface thereof representing a contact surface of the two molded components.

"Circumferential surface" means in particular the other regions of the surface of the molded component, which are not to be associated to the plane surface, i.e., the surface that serves to contact a further molded component of ceramic. The circumferential surface may have any desired contour. Preferably, however, the circumferential surface is composed of substantially flat surfaces. Especially preferred is a substantially rectangular construction of the molded component, with one of the two largest surfaces representing the plane surface. Yet, the molded component may have special contact surfaces, grooves, stop edges, etc. for purposes of simplifying positioning relative adjacent components.

According to an advantageous further development of the device, at least one bore of the molded component is provided with a rotationally asymmetric cross section for the elongate guideway. In a particularly simple manner, the described bores permit mounting the molded ceramic component to metallic components. A first bore of two bores is used to secure the position of the molded component in particular in a localized fashion. However, it is also necessary to provide a second possibility of securing the molded component, which prevents a free rotation about the first bore. To this end, it is proposed to provide a second bore that has a rotationally asymmetrical cross section. This means in particular that the bore has a cross section, which has a greater extension in one direction than in one or all directions deviating therefrom. With such a configuration of the second bore, the greater extension serves to form a type of guideway. If a fastener is positioned through this bore, it will be able to shift in the rotationally asymmetric cross section in a translationally guided manner, for example, because of the thermal expansion behavior. This represents a particularly preferred possibility of configuring a molded component for purposes of considerably lessening the initially described technical problems.

It should furthermore be remarked that in certain variants of the device the bores may be constructed as so-called "blind hole" bores. These extend only from the circumferential surface as far as internal regions of the molded component. Preferred, however, is the variant wherein the bores extend from the circumferential surface as far as the plane surface. This permits securing the molded component from the plane surface to the other components, whereby assembly work is clearly simplified.

According to a further configuration of the molded component, at least one recess extends between two end faces of the molded component and thus spaces the at least two bores from each other. This means in particular that the recess extends over the entire length of the plane surface or the molded component, and thus subdivides it into two halves. According to this variant, the first bore is provided in the one half and the second bore with a rotationally asymmetric cross section in the second half. In this manner, the source of the developing temperatures, i.e., the nozzle channel formed by the recess is positioned within the mounting or support point, thereby ensuring a more exact positioning of the nozzle outlet also at high temperatures or great temperature fluctuations.

In a further configuration of the molded component, the plane side is provided with at least one chamber that has a cavity toward the at least one recess, with the one bore with the rotationally asymmetric cross section being farther removed from the chamber than the other bore. Advantageously, the chamber also provides a connection between the plane surface and the circumferential surface, and serves in particular to supply the heated conveying medium, such as, for example, vapor or gas. In view of the fact that it is intended to supply via this chamber a fluid to the recess, it is necessary to join the chamber to the fluid delivering parts in an exact manner. The proposed configuration, wherein the long hole bore is provided far removed from the chamber, ensures that least possible displacements of material because of thermal expansion occur in the region of the chamber. With that, a relatively tight transition toward the fluid delivering parts is ensured.

Furthermore, it is proposed that the at least two bores comprise a bore in the form of a round hole and a bore in the form of a long hole. "Round hole" essentially means a cylindrical configuration of the bore. It serves to receive, for example, an alignment pin, which has likewise a cylindrical shape. Preferably, the bore has a form tolerance of less than 0.15 mm. "Long hole" means such bores, which are each semicircular in two opposite end sections, but extend substantially in a straight line in the intermediate sections. Basically, it is also possible to select in the place of semicircular end sections other shapes, for example, straight stop edges, oval shapes, etc. The advantage of a configuration of the second bore as a long hole is that it predetermines a guideway for exactly one direction. With that, it is possible to predetermine or limit the behavior of the molded component more exactly in the case of thermal alternating stresses.

Furthermore, it is also proposed that the at least one recess has a center axis, and that the one bore with the rotationally asymmetric cross section in the form of a long hole bore has an axis of extension, with the center axis and the axis of extension being parallel to each other. As a special effect thereof, the long hole bore permits different thermal expansion behaviors of the adjacent component relative to the molded component in the direction of the nozzle channel. This has the advantage that likewise in this case the nozzle channel extends into the subsequent stuffer box chamber still in alignment therewith, and that thus constant qualities with respect to the yarn plug are ensured over a wide temperature range near the ceramic nozzle.

Furthermore, it is advantageous that the at least one ceramic nozzle is made with two identical molded components, which abut with their plane surfaces such that the recesses of both molded components form together a nozzle channel with an inlet at one face end and an outlet at a second face end. Preferably, the nozzle channel is formed in the direction of an axis, but may have under circumstances varying channel cross sections. In particular, the nozzle channel has near the outlet a larger channel cross section than in the internal regions of the ceramic nozzle. To ensure that both molded components are subjected as much as possible to uniform stress, the recesses are shaped such that the nozzle channel wall is equally formed by each of the molded components. It is especially preferred to arrange all recesses in the molded components symmetrically with respect to a center line, which corresponds in particular to the center axis. With that, the variety of components for making such ceramic nozzles is clearly reduced, because it becomes thus possible to join always the same molded components.

Furthermore, it is also proposed to provide the molded components of the at least one ceramic nozzle with respectively two chambers with cavities leading toward the recesses, with a hollow space being formed together with respectively one chamber of a molded component, and a supply channel together with respectively one cavity of a molded component. The hollow space serves as a stabilizing area for an entering conveying fluid, in particular a gas. The connections for the supply line of the conveying fluid are advantageously provided only on one side of the ceramic nozzle. The other side of the cavities can be closed by adjacent components. Proceeding from the hollow spaces, the conveying fluid enters the nozzle channel via supply channels. Advantageously, the channel cross section or the nozzle channel widens in the region where the supply channels and the nozzle channels converge. The supply channels extend toward the nozzle channel at an acute angle, so that the entering conveying fluid has already a great velocity component in the direction of the center axis of the nozzle channel. In this manner, it is avoided that undesired turbulences occur in the flow when being deflected into the nozzle channel, which would lead to an uncontrolled advance of the yarn.

In this connection, it is especially advantageous that the formfitting mount comprises respectively one bore in the form of a round hole that extends at least in part respectively into the molded component and into the housing, with the two being aligned with each other such that an alignment pin extends at least in part into both bores. In this case, the alignment pin is substantially cylindrical and lies with a predominant portion of its circumferential surface in the bores against the material of the molded component as well as the housing. Preferably, this alignment pin extends almost as far as the plane surface of the molded component, so that same is easy to remove when needed.

According to a further configuration, it is proposed that the elongate guideway comprises a bore in the form of a long hole in at least the molded component or the housing, which extends at least in part into the molded component or the housing, with a guide pin extending at least in part into the bore constructed as a long hole. Preferred is the configuration, wherein a bore in the form of a long hole is provided in the molded component, whereas the housing likewise contains a bore in the form of a round hole. As a consequence, the guide pin is stationarily arranged relative to the housing, but displaceable relative to the ceramic nozzle or the respective molded component. If the housing of metal undergoes a thermal expansion, which is greater than the thermal expansion of the molded ceramic component, the guide pin will be guided in the bore that is made as a long hole. This ensures a degree of freedom of movement for the connection of housing/molded component, so that the different thermal expansion behavior can be compensated during operation without jeopardizing the functionality of the ceramic nozzle or the device.

Furthermore, it is also proposed that the bore in the form of a long hole has a maximal extension in the direction of an axis of extension. This maximal extension is at least 0.2 mm greater than a dimension of the guide pin. In particular, this maximal extension is dimensioned such that at the maximally reachable temperature during operation, there still remains a clearance of at least 0.05 mm. Basically the maximal extension is selected with reference to the allowable displacements. Preferably, the bore in the form of a long hole is also at least 0.01 mm larger at a maximum temperature load in operation (about 300° C.) in the direction perpendicular to the maximal extension than the dimension of the guide pin, so as not to impede the relative movement by friction.

According to yet a further configuration of the device, at least the alignment pin or the guide pin contains a metallic material. Preferably, both the alignment pin and the guide pin are metallic. With that, it is ensured that these have an expansion behavior similar to the housing, and that the position relative the housing is thus constantly secured, i.e., the attachment to the housing is prevented from becoming loose.

Furthermore, it is advantageous to configure the housing such that it presses the at least two molded components of a ceramic nozzle with their plane surfaces against each other in a sealing manner. This means in particular that the plane surfaces come to lie against each other such that the fluids conveyed in the ceramic nozzle are unable to leave the nozzle channel and/or the hollow spaces formed by the molded components. It is particularly preferred to make the contact airtight, in particular even when the overpressures prevailing in operation are applied in the nozzle channel. In this connection, the molded components are not directly joined to each other permanently or releasably, but are only pressed against each other with their plane surfaces while in use. With that, there is in particular no longer a need for formfitting screw connections to secure the two molded components. In this case, the molded components are preferably constructed as flat plates. At the same time, it is possible to eliminate a costly and time-consuming microfinishing of the plane surfaces in the production of the molded components.

Preferably, the channels, hollow spaces, etc. in the interior of the ceramic nozzle are equally formed with each of the molded components. With that, the plane surface represents during operation preferably also a contact surface, with the two plane surfaces butting against each other for the most part.

According to a further configuration of the device, at least one ceramic nozzle is positioned in formfitting engagement with its outlet in a yarn inlet of a stuffer box chamber downstream thereof in the direction of the advancing yarn. In other words, this means that a formfitting stop or contact is provided in the axial direction or in the direction of the nozzle channel or plug channel. The formfitting engagement is preferably provided by self-centering molded elements of the ceramic nozzle and the stuffer box chamber, such as, for example, conical or tapered configurations of the outlet and/or inlet ends. To ensure a durable formfitting engagement, it is possible to secure the ceramic nozzle and stuffer box chamber with fasteners outside the region of the formfitting connection.

In this connection, it is preferred that the yarn inlet contains ceramic material at least in the region of the formfitting contact. This ensures, for example, that the plug contacts only a very resistant, abrasionproof material. With that, it is possible to lengthen the service life considerably and to ensure an excellent yarn quality over a long period.

Furthermore, it is also proposed that the outlet comprising a nozzle tip forms a first fitting surface, and the yarn inlet having an inlet section a second fitting surface, with the first fitting surface contacting the second fitting surface. Preferably, two molded components form the first fitting surface. The first and second fitting surfaces are made in one section in the way of a cone, so that the nozzle tip or the nozzle channel is centered when assembling the device for stuffer box crimping, and extends into the yarn inlet in alignment therewith.

Preferably, the nozzle channel of the ceramic nozzle merges directly into the plug channel of the stuffer box chamber. "Directly" means that there is no significant offset or gap between the two treatment channels, but that a direct transition is provided.

Under a further aspect of the invention, a device for stuffer box crimping a synthetic multifilament yarn is proposed, which is constructed with a divided ceramic nozzle (as feed nozzle) and a stuffer box chamber downstream thereof. The ceramic nozzle comprises at least one yarn feed channel and at least one nozzle outlet channel. The device is characterized in that the ceramic nozzle comprises a divided nozzle body with two molded components, which are made in the form of flat plates.

"Yarn feed channel" means the portion of the nozzle channel, in which the filaments do not yet undergo a yarn treatment within the ceramic or feed nozzle. The region of the nozzle channel, in which the filaments are treated as far as the outlet, is called "nozzle outlet channel." The "nozzle body" features in particular two joined molded components, so that they define the channels. A "platelike" construction means first and foremost that it is not made with semicylinders, but that substantially flat and preferably also (nearly) parallel circumferential surfaces face the plane surfaces. The platelike molded components are "flat" in particular when they have a thickness of less than 10 mm. Preferably, the thickness is in a range from 6.0 mm [millimeters] to 4.0 mm.

Furthermore, it is also proposed that each of the two molded components is installed in two housing halves, with overlying plane surfaces of the molded components forming sealing surfaces. In this connection, it is especially preferred that the two molded components are joined via formfitting means, in particular also inserted into the housing halves. "Fitting means" include in particular the above described means for a formfitting mount and an elongate guideway in a plane parallel to the plane surface.

Furthermore, it is especially advantageous that the two molded components are made substantially symmetrical, that they each include half of at least one yarn feed channel, half of at least one air supply channel, and half of at least one nozzle outlet channel, which are inserted into corresponding plane surfaces of the molded components, with the plane surfaces defining in their assembled state the channels in an airtight manner. "Air supply channel" describes in particular a channel, through which a conveying medium enters the yarn feed channel, which lastly is also used for treating the filaments. Normally, the outlet of the air supply channel into the nozzle channel represents a boundary between the yarn feed channel and nozzle outlet channel. Preferred are two air supply channels, which extend into the nozzle channel at an acute angle.

For the sake of clarity, it should be remarked that both aspects of the invention, significantly improve, individually or in combination, the device with respect to producing yarn plugs with high precision, even when significant temperature fluctuations occur in the vicinity of the feed nozzle. Furthermore, the configurations of the devices for stuffer box crimping a synthetic multifilament yarn exhibit a clearly improved resistance to wear as regards the yarn-guiding components.

BRIEF DESCRIPTION OF THE DRAWINGS

In the following, the invention is described in greater detail with reference to the several Figures, which schematically illustrate especially preferred embodiments of the invention, without however limiting the scope of the invention it to the illustrated embodiments. In the drawing.

DETAILED DESCRIPTION OF THE PREFERRED EMBODIMENTS

Figure 1:
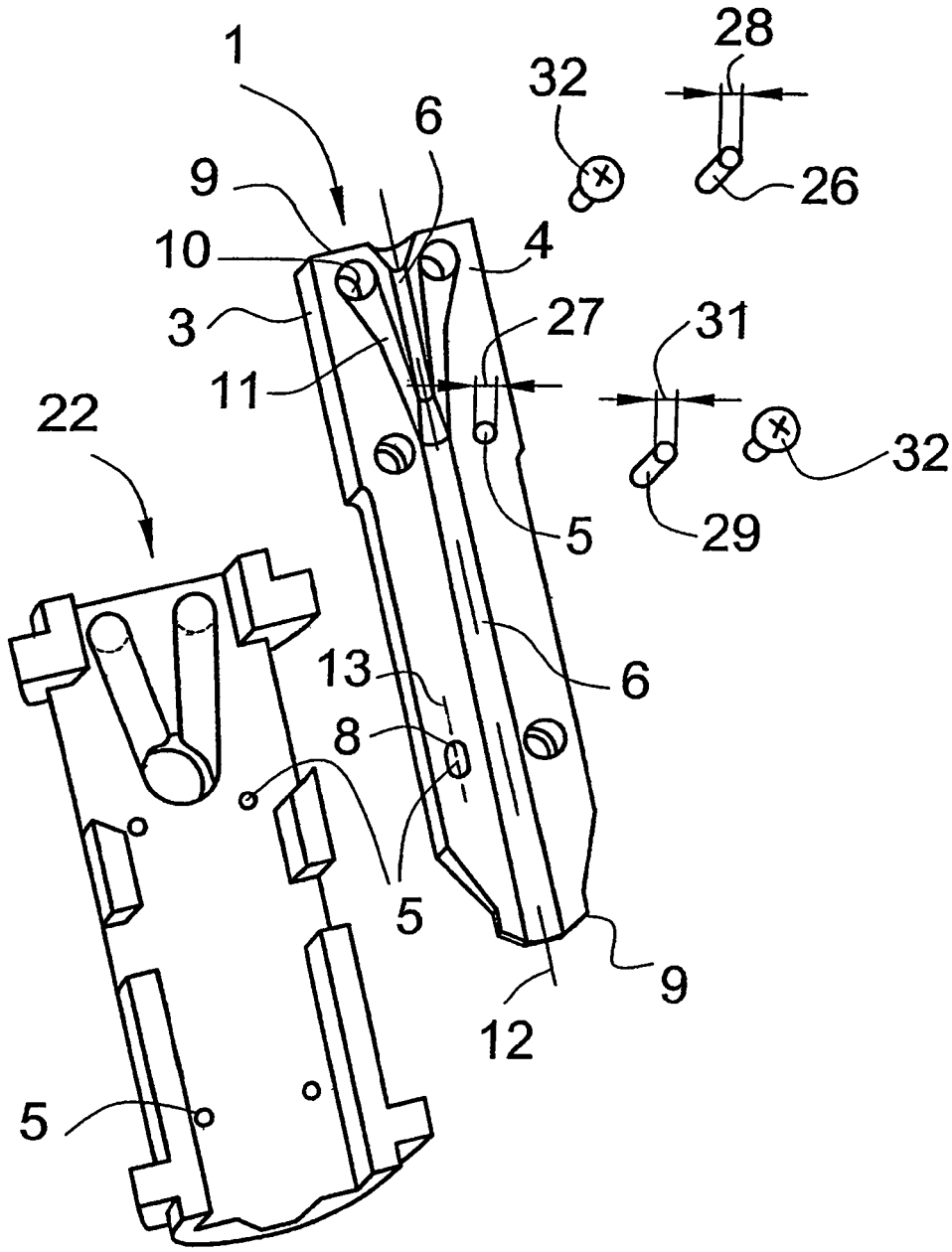
FIG. 1 is an exploded view of a component of the device according to the invention.

FIG. 1 schematically illustrates a perspective and exploded view of a ceramic molded component 1 with an associated housing 22 as well as the necessary means to secure the molded component 1 to the housing.

The ceramic molded component 1 comprises a circumferential surface 3, a plane surface 4, and two end faces 9 (which are part of the circumferential surface 3). For each molded component 1, at least two bores 5 are provided, which each extend toward a circumferential surface 3. The plane surface 4 contains the bores 5, chambers 10, cavities 11, and recesses 6. The chambers 10 and cavities 11 are arranged in symmetric relationship with the recess 6. The chambers 10 are configured to extend as passages through the molded component 1. The recess 6 extends along a center axis 12 between the two end faces 9, with one chamber 10 and one cavity 11 being each arranged in mirror symmetry with the center axis 12.

One of the two bores 5 is a round hole and has a diameter 27, whereas the other bore 5 is in the form of an elongate hole which has an asymmetric cross section 8 and an axis of extension 13. These two bores 5 likewise extend through the molded component 1, so as to permit fasteners to extend therethrough. The bore 5 shown in the upper right of FIG. 1, which is made as a round hole is used to receive an alignment pin 26 of a diameter 28 that closely corresponds to the diameter 27 of the bore 5.

The elongate hole bore 5 shown in exaggerated form in the lower left serves to receive a guide pin 29 which has a diameter 31. This bore 5 having a rotationally asymmetric cross section 8 has an extension 30 in the direction of the axis of extension 13, which is clearly greater than the diameter 31 of the guide pin 29.

In this manner, two different means for securing the molded component 1 to the housing 22 are provided, namely on the one hand a formfitting mount and on the other hand an elongate guideway.

The alignment pin 26 and the guide pin 29 respectively extend through the molded component 1. They are secured in corresponding bores 5 of the housing 22, which are provided as round holes. In addition, the housing 22 forms in sections receptacles, which abut (relatively loosely) near the circumferential surface 3 of the molded component 1.

While the alignment pin 26 and the guide pin 29 provide for securing the molded component 1 relative to the housing 22 in a plane 25 parallel to the plane surface 4, additional fasteners are provided for securing in the Z-direction, i.e., perpendicular to the described plane 25, to prevent the molded component 1 from lifting from the housing 22. These fasteners take the form of metallic screws 32, which are received in bores which extend through the component 1. The bores have shoulders below the plane surface 4, which engage the heads of the screws and permit the heads to lie below the plane surface 4. The bores required therefor are made clearly greater than the diameter of the screw shank, so that the screws 32 do not provide for a guidance and fastening in the plane 25 parallel to the plane surface 4. Only the contact of the screw head with the shoulder in the bore ensures a fastening in the Z-direction.

Figure 2:
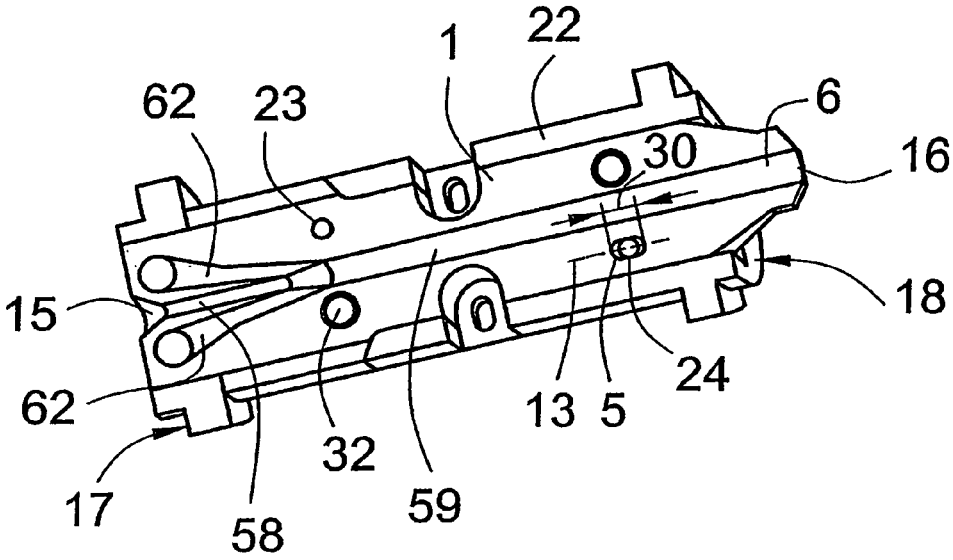
FIG. 2 shows a further embodiment of a component of the device according to the invention.

FIG. 2 illustrates in a schematic and perspective view the assembled state of a housing 22 and a molded component 1. This assembly represents in particular also half a ceramic nozzle 2. The recesses 6 then form together a nozzle channel 7, which includes an inlet 15 near a first face end 17 and an outlet 16 near a second face end 18. The nozzle channel 7 comprises a yarn feed channel 58 and a nozzle outlet channel 59, which are defined by the outlet of two air supply channels 62. In the illustrated embodiment, the recess 6 in between a formfitting mount 23 and an elongate guideway 24, which ensure that the molded component 1 is secured relative to the housing 22 in the plane 25 parallel to the plane surface 4. Perpendicularly thereto, the screws 32 provide for the necessary contact pressure of the molded component 1 on the housing 22 at least in an unheated state of the ceramic nozzle 2, and/or during repair measures, or in the disassembled state. During operation, it is preferred that the metallic screws 32 respond such that same have at most an insignificant contact with the molded component 1. The attachment in the Z-direction then occurs via the other molded component 1 that is pressed thereagainst.

In the illustrated variant of the embodiment, the elongate guideway 24 is again shown (in clearly exaggerated form) as a bore 5 made as a long hole. The bore 5 has a maximal extension in the direction of the axis of extension 13.

Figure 3:
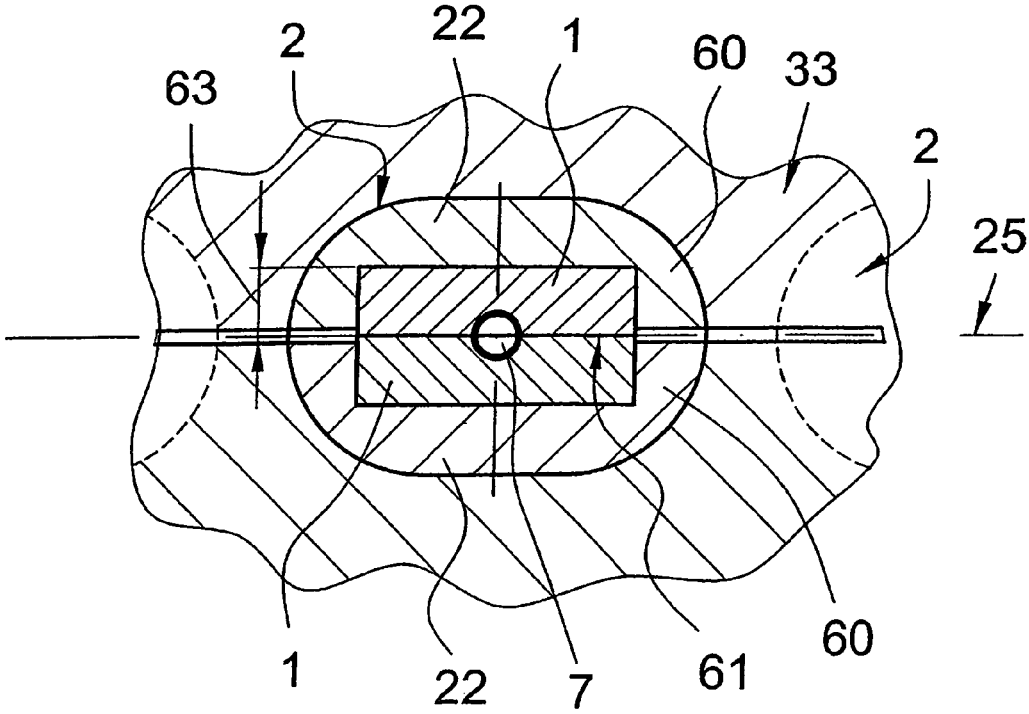
FIG. 3 is a sectional view of another embodiment of the device according to the invention.

FIG. 3 is a sectional view of a fragment of a device for producing a crimped yarn, wherein a plurality of ceramic nozzles 2 are mounted side by side in a nozzle plate 33. The ceramic nozzle 2 is formed by two housing halves 60 or receptacles of a housing 22 as well as two molded components 1. Each molded components 1 are each made as a flat plate with a thickness 63 in a range from 4.0 mm to 6.0 mm. The molded components 1 lie against each other with their plane surfaces 4 and define a plane 25 and a sealing surface 61, which effects an airtight boundary of the nozzle channel 7. The necessary contact pressure is realized via the housing halves 60 of the housing 22, which do not contact each other to ensure a uniform contact pressure of the two molded components 1. The center of the ceramic nozzle 2 shows the nozzle channel 7.

Figure 4:
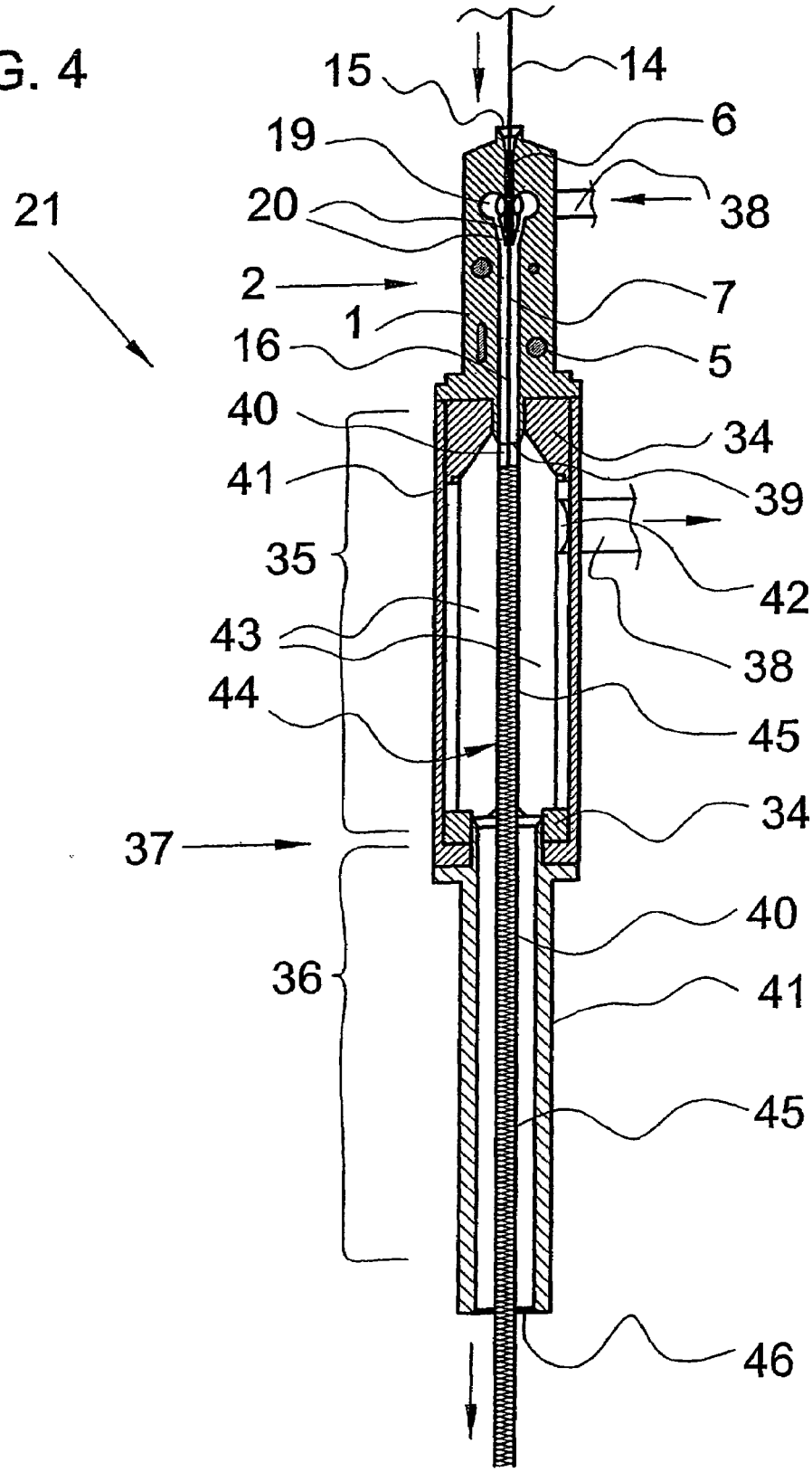
FIG. 4 is a schematic view of the structure of a device for stuffer box crimping a multifilament yarn with a variant of the ceramic nozzle.

FIG. 4 schematically illustrates a cross sectional view of an embodiment of the device 21 for stuffer box crimping a synthetic multifilament yarn. The device comprises a ceramic nozzle 2 and a stuffer box chamber 37 downstream of the ceramic nozzle 2. The ceramic nozzle 2 includes a nozzle channel 7, which forms at its one end an inlet 15 and at its opposite end an outlet 16. The ceramic nozzle 2 connects via a line 38 to a source of pressure (not shown). Supply channels 20 and hollow spaces 19 connect the line 38 to the nozzle channel 7. The entry of a heated conveying fluid under pressure is realized by a plurality of hollow spaces 19, so that the conveying fluid is supplied to the nozzle channel 7 in the direction of the advancing yarn, which is shown by arrows. With its outlet 16, the nozzle channel 7 extends into a plug channel 40 of the stuffer box chamber 37.

Near the inlet 15, the ceramic nozzle 2 receives a yarn 14, which advances along the nozzle channel 7. To secure the molded component 1 to a housing (not shown), a formfitting mount and an axial guideway are provided by correspondingly formed bores 5.

The stuffer box chamber 37 is formed by a first section 35 facing the ceramic nozzle 2 with a yarn inlet 39, and a second section 36 downstream of the first section 35 with a plug outlet 46. In the first section 35, a plug channel 40 is formed by a friction surface 43 with a gas-permeable chamber wall. The gas-permeable chamber wall contains a plurality of lamellas 44 which extend in an annular pattern with small spaces between them. The lamellas 44 are held by a holder 34 at the upper end of the first section 35 and by a further holder 34 at the lower end of the first section 35. The lamellas 44 and the holders 34 are arranged within an enclosure formed with a wall 41, with the wall 41 being closed toward the outside and connecting only through an opening 42 to a suction system (not shown).

On the side facing the yarn plug 45, the lamellas 44 have each a friction surface 43. Preferably, the lamellas 44 are made of a ceramic material, so that the friction surfaces 43 consist of a wear-resistant material.

Downstream of the gas-permeable chamber wall, a closed wall 41 is provided, which forms a plug channel 40. The plug channel 40 in the second section 36 is made larger in diameter than the plug channel 40 inside the first section 35 with the gas-permeable chamber wall. At its end, the plug channel 40 in the second section 36 forms the plug outlet 46.

The embodiment of the device according to the invention as shown in FIG. 4 is shown with an advancing yarn to better illustrate the operation of the device. In this process, the ceramic nozzle 2 advances the yarn 14 into the nozzle channel 7 by means of a conveying fluid that is supplied via supply channels 20. The yarn 14 enters the nozzle channel 7 via the inlet 15. As conveying fluid, it is preferred to use heated air or heated gas.

The conveying fluid flowing at a high velocity causes the yarn 14 to advance at a high speed toward the stuffer box chamber 37. In this process, a yarn plug 45 forms in the plug channel 40. The yarn 14 which consists of a plurality of filaments, is deposited on surface of the yarn plug 45, so that the filaments form loops and coils. The conveying fluid is removed by suction between the lamellas 44 through the opening 42. The yarn plug 45 forming in the plug channel 40 lies against the friction surfaces 43 of the lamellas 44. The frictional forces and the conveying pressure of the conveying fluid, which acts upon the yarn plug 45 are substantially at equilibrium, so that the yarn plug diameter remains essentially unchanged within the plug channel 40. Since the lamellas 44 are made of a ceramic material, the equilibrium of forces acting upon the yarn plug 45 is maintained for the most part by keeping the pressure of the conveying fluid constant.

The yarn plug 45 then enters the second section 36 of the stuffer box chamber 37, which is formed by the closed wall 41. The closed wall 41 in the section 36, which may be made tubular, serves to guide only the yarn plug 45 to a downstream cooling device not shown. In the region of the second section 36, the plug channel 40 is made larger than the plug channel 40 in the region of the first section 35, so that only small frictional forces act upon the yarn plug 45 in the second section 36. A protection against wear is therefore not needed.

Figure 5:
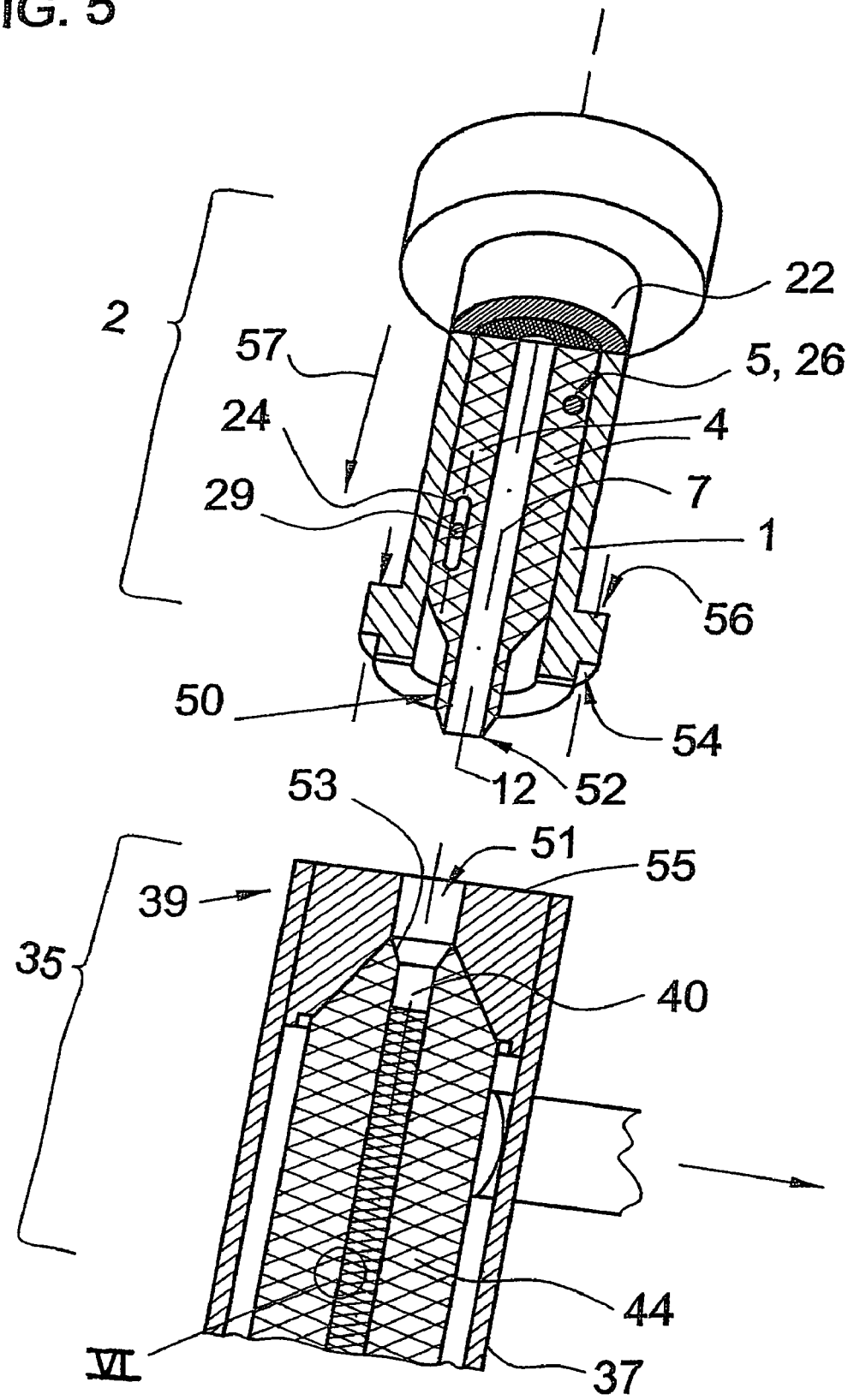
FIG. 5 shows a variant of a ceramic nozzle with a stuffer box chamber.

The upper portion of FIG. 5 schematically illustrates a variant of the ceramic nozzle 2, and the lower portion shows the stuffer box chamber 37 with the upper portion of the first section 35.

Best seen in FIG. 5 is the bipartition of the ceramic nozzle 2 with the plane surfaces 4 as well as the fitting means (round bore 5 and alignment pin 26, as well as the bore with the asymmetrical cross section 8 and guide pin 29), which serve to align and secure in particular the two ceramic molded components 1 in exact relationship with the housing.

Figure 6:
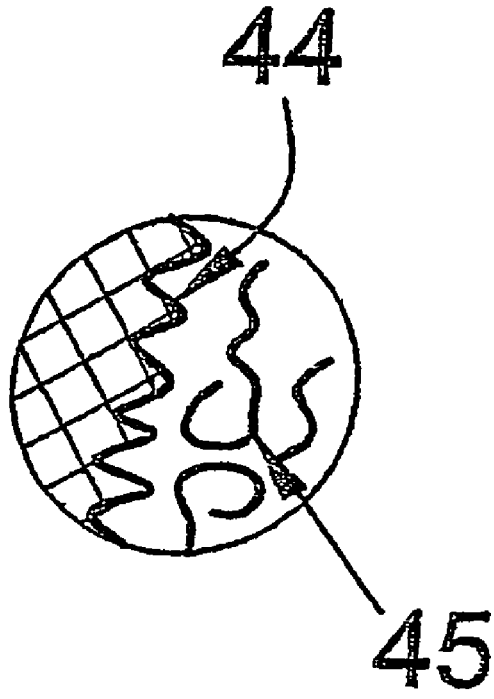
FIG. 6 is a detail view of the stuffer box chamber of FIG. 5.

The ceramic nozzle 2 is positioned with its outlet 16 in formfitting engagement with a yarn inlet 39 of a stuffer box chamber 37 downstream thereof in the direction 57 of the advancing yarn. To align the center axes 12 of the ceramic nozzle 2 with the stuffer box chamber 37 in the assembled state, and to prevent a discontinuity of the ceramic friction points from forming between the nozzle channel 7 and the plug channel 40, both molded components 1 comprise a common nozzle tip 50, which is received in an entry section 51. Such an entry section 51 can be formed, for example, in a holder 34 of the stuffer box chamber 37. Corresponding first fitting surfaces 52 on the nozzle tip 50 as well as second fitting surfaces 53 on the entry section 51 are conical and center the ceramic nozzle 2 relative to the stuffer box chamber 37. First and second connecting surfaces 54, 55 position the ceramic nozzle 2 exactly relative the stuffer box chamber 37. In this connection, the nozzle channel 7 of the ceramic nozzle 2 directly merges into the plug channel 40 of the stuffer box chamber 37, which is provided with lamellas 44 (see detail of FIG. 6).

In FIG. 5, the ceramic components are highlighted by cross-hatching. Via connecting means 56, the housing 22 of the ceramic nozzle 2 is mounted to the wall of the stuffer box chamber. However, it is also possible to mount the ceramic nozzle to the stuffer box chamber 37 with special connecting means 56, such as, for example, a bayonet joint.

The new invention proposes a ceramic nozzle for a device for stuffer box crimping a synthetic multifilament yarn. The ceramic nozzle 2 comprises a divided nozzle body, consisting of two molded ceramic components. Preferably, the molded ceramic components are made as two flat plates and combined with precision by fitting means. The molded ceramic components abut each other via their two plane surfaces and form together a nozzle tip, which extends into the plug channel. Together, they border the entire channel with ceramic. A special advantage of the flat ceramic plates, which are each enclosed in a metal housing half, also lies in an optimal protection against mechanical damage.

Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A device for use in a stuffer box crimping apparatus for crimping a synthetic multifilament yarn, comprising a housing composed of a metallic material, a nozzle mounted within said housing, said nozzle comprising at least two molded ceramic components having respective plane surfaces which are disposed in overlying face to face relationship, with at least one of the plane surfaces having a recess which defines a nozzle channel for passage of the yarn, and means for joining each component to the housing comprising a) a formfitting mount connecting the component in the housing at a first location, and b) a second mount connecting the component to the housing at a second location and including an elongate guideway which extends in a direction parallel to the overlying plane surfaces of the components and so as to permit limited relative movement between the component and the housing at the second location.

2. The device of claim 1, wherein the elongate guideway of each second mount comprises a bore in the component or the housing which has an asymmetric cross section.

3. The device of claim 1, wherein the recess in the at least one plane surface extends between two end faces of the component and with the first and second locations lying on opposite sides of the recess.

4. The device of claim 3, wherein each component further comprises at least one chamber and a cavity in the plane surface extending from the chamber into the recess, and wherein the second mount is further removed from the chamber than is the formfitting mount.

5. The device of claim 2, wherein the recess defines a central axis, and wherein the bore in the component or the housing which has an asymmetric cross section defines an axis of extension which is parallel to the central axis.

6. The device of claim 1, wherein the nozzle comprises two identical molded ceramic components with the respective plane surfaces overlying each other in face to face relationship and with each of the plane surfaces having a recess and so that the recesses collectively form the nozzle channel, and so that the nozzle channel defines an inlet at a first end face and an outlet at a second end face.

7. The device of claim 6, wherein the two molded components each further comprise two chambers, and a cavity extending from each chamber to the associated recess, and with the chambers being connected to an air or gas supply line.

8. The device of claim 1, wherein the formfitting mount of each component comprises a bore in the form of a round hole which extends through or into the component and a second bore in the form of a round hole which extends through or into the housing, and an alignment pin extending into the bore of both the component and the housing so as to maintain the bores in alignment.

9. The device of claim 8, where in the elongate guideway of the second mount comprises a bore in the form of an elongate hole which extends through or into one of the component and the housing, and a guide pin fixed to the other of the component and the housing and extending into the bore of the elongate guideway.

10. The device of claim 9, wherein the bore of the elongate guideway has a maximal extension in the direction of an axis of extension, with the maximal extension being at least 0.2 mm greater than the diameter of the guide pin.

11. The device of claim 9, wherein the alignment pin and/or the guide pin are composed of a metallic material.

12. The device of claim 1, wherein the housing is configured to press the at least two molded components together so that the respective plane surfaces are pressed against each other in a sealing manner.

13. The device of claim 1, further comprising a stuffer box chamber positioned downstream of the nozzle, and said nozzle having an outlet positioned in a formfitting manner in a yarn inlet of the stuffer box chamber.

14. The device of claim 13, wherein the yarn inlet of the stuffer box chamber comprises a ceramic material at least in the region of formfitting contact.

15. The device of claim 13, wherein the outlet of the nozzle includes a nozzle tip which forms a first fitting surface, and the yarn inlet of the stuffer box chamber includes an inlet section which forms a second fitting surface, with the first fitting surface contacting the second fitting surface.

16. The device of claim 13, wherein the nozzle channel of the nozzle merges directly into a plug channel of the stuffer box chamber.

17. A stuffer box yarn crimping apparatus comprising a divided ceramic nozzle comprising two molded components having overlying face to face plane surfaces, and which define a nozzle channel therebetween, a stuffer box chamber positioned immediately downstream of the nozzle so as to communicate with the nozzle channel, and wherein the two molded components of the nozzle are configured as flat plates, with the plates defining said plane surfaces.

18. The apparatus of claim 17 wherein each of the two molded components of the nozzle is supported by two housing halves respectively, with the overlying plane surfaces forming sealing surfaces to seal the nozzle channel.

19. The apparatus of claim 18, wherein the two molded components are joined to the associated housing half by fitting members which extend between each molded component and the associated housing half.

20. The apparatus of claim 17, wherein the two molded components of the nozzle are substantially identical in configuration, with each of the components having a yarn feed channel, at least one air supply channel, and a nozzle outlet channel formed in the associated plane surface, and so that in the overlying relationship of the plane surfaces the respective yarn feed channels, air supply channels, and outlet channels overlie each other in an airtight manner.

21. A stuffer box yarn crimping apparatus for crimping a synthetic multifilament yarn, comprising a housing composed of a metallic material, a nozzle mounted within said housing, said nozzle comprising at least two molded ceramic components having respective plane surfaces which are disposed in overlying face to face relationship, with the plane surfaces each having a recess and so that the recesses collectively define a nozzle channel for passage of the yarn, and means for joining each component to the housing comprising a) a formfitting mount connecting the component in the housing at a first location, and b) a second mount connecting the component to the housing at a second location and including an elongate guideway formed in one of the component and the housing and which extends in a direction parallel to the overlying plane surfaces of the components, and a guide pin fixed to the other of the component and the housing and received in the elongate guideway so as to permit limited relative movement between the component and the housing at the second location in the direction of the elongate guideway, and a stuffer box chamber positioned immediately downstream of the nozzle so as to communicate with the nozzle channel.

22. The apparatus of claim 21 wherein the elongate guideway has a major dimension which extends in a direction parallel to the nozzle channel.

* * * * *